US008220544B2

(12) United States Patent
Harris et al.

(10) Patent No.: US 8,220,544 B2
(45) Date of Patent: Jul. 17, 2012

(54) CEMENTING WITH ELECTRIC LINE COILED TUBING

(75) Inventors: Robert Harris, Willow, AK (US); Mark Johnson, Anchorage, AK (US)

(73) Assignee: Baker Hughes Incorporated, Houston, TX (US)

( * ) Notice: Subject to any disclaimer, the term of this patent is extended or adjusted under 35 U.S.C. 154(b) by 186 days.

(21) Appl. No.: 12/637,105

(22) Filed: Dec. 14, 2009

(65) Prior Publication Data

US 2010/0218951 A1 Sep. 2, 2010

Related U.S. Application Data

(60) Provisional application No. 61/122,914, filed on Dec. 16, 2008.

(51) Int. Cl.
*E21B 43/00* (2006.01)

(52) U.S. Cl. ..... 166/290; 166/177.4; 166/65.1

(58) Field of Classification Search ..... 166/65.1, 166/290, 177.4
See application file for complete search history.

(56) References Cited

U.S. PATENT DOCUMENTS 7,325,606 B1 * 2/2008 Vail et al. ..... 166/250.15
7,857,052 B2 * 12/2010 Giroux et al. ..... 166/289
2008/0128128 A1 * 6/2008 Vail et al. ..... 166/250.15

* cited by examiner

*Primary Examiner* — William P Neuder
(74) *Attorney, Agent, or Firm* — Steve Rosenblatt

(57) ABSTRACT

An open hole is drilled with coiled tubing that has an electric line. At the conclusion of drilling the drilling bottom hole assembly is removed and a liner running tool is connected between the coiled tubing and the liner. The electric line remains in the coiled tubing but spacers can be added to keep the lower end of the electric line away from the running tool. A wiper plug has a passage therethrough and a movable stinger that can hold open a pair of flapper valves. The liner is released from the running tool and cement is delivered through the stinger with a bit of excess that is above the running tool. The lifting of the stinger with the coiled tubing closes the flappers and allows circulation out of excess cement. Setting down on the coiled tubing allows a seal to re-engage in the deployment sleeve, allowing pressure to be placed against the wiper plug, such that it can be launched to displace the remaining cement within the liner into the annulus around the liner.

19 Claims, 2 Drawing Sheets

CEMENTING WITH ELECTRIC LINE COILED TUBING

CROSS-REFERENCE TO RELATED APPLICATION

This application claims priority from U.S. Provisional Application No. 61/122,914, filed on Dec. 16, 2008.

FIELD OF THE INVENTION

The field of this invention is well completions and more particularly liner cementing of a well drilled with electric line coiled tubing using the same coiled tubing as was used to drill the well.

BACKGROUND OF THE INVENTION

One way a wellbore can be drilled is to use a downhole motor supported by coiled tubing. A drill bit is powered by the downhole motor and flow through the coiled tubing operates the motor. Part of the bottom hole assembly includes known tools to steer the bit so that the well is drilled with the desired orientation. The communication between the bottom hole assembly (BHA) and the surface takes place through an electric line inside the coiled tubing. After the well was drilled to the target depth, the BHA was removed with reeling in the coiled tubing and a separate coil of coiled tubing without an electric line was connected to a liner to be run in to hole bottom and then cemented.

The reason that two separate coils were required was that the coil used for drilling had the electric line in it and when it came time to displace cement that had to go through the coiled tubing a wiper plug that was typically used for cement displacement could not go down the coiled tubing because the electric line was in it. To get around this problem in the past, a separate coiled tubing reel was kept at the surface of the well so that at the conclusion of the drilling operation the reel of coiled tubing without the electric line could be deployed along with a liner running tool so that the liner could be delivered to hole bottom. Once on bottom the liner was released but remained in a sealed relation to the running tool so that cement could be delivered in the required volume into the liner. The liner had a cementing shoe on bottom. Typically, the liner had a wiper plug on top with a passage through it through which the cement was delivered. After delivery of a measured volume of cement a dart would be launched to land in the wiper plug and pressure was built up to launch the wiper plug to land it just above the cement shoe at the liner bottom. This would push all the cement into the annular space surrounding the liner. The coiled tubing could then be released from the liner and the excess cement circulated out. The coiled tubing would then be coiled up on the reel at the surface. While this procedure got the job done it was expensive to keep two coiled tubing reels at the well site and the present invention addresses a way to get the same job done without employing the second coiled tubing assembly. It can also provide an assurance that uncontaminated cement is delivered to the annulus around the liner to be cemented and a way to remove an excess amount of barrier cement from the coiled tubing to insure its continuing functionality for other jobs. These and other aspects of the present invention will be more readily apparent to those skilled in the art from a review of the detailed description of the preferred embodiment and the associated drawings while recognizing that the full scope of the invention is to be determined by the literal and equivalent scope of the attached claims.

SUMMARY OF THE INVENTION

An open hole is drilled with coiled tubing that has an electric line. At the conclusion of drilling the drilling bottom hole assembly is removed and a liner running tool is connected between the coiled tubing and the liner. The electric line remains in the coiled tubing but spacers can be added to keep the lower end of the electric line away from the running tool. A wiper plug has a passage therethrough and a movable stinger that can hold open a pair of flapper valves. The liner is released from the running tool and cement is delivered through the stinger with a bit of excess that is above the running tool. The lifting of the stinger with the coiled tubing closes the flappers and allows circulation out of excess cement. Setting down on the coiled tubing allows a seal to re-engage in the deployment sleeve, allowing pressure to be placed against the wiper plug, such that it can be launched to displace the remaining cement within the liner into the annulus around the liner.

DETAILED DESCRIPTION OF THE DRAWINGS

DETAILED DESCRIPTION OF THE PREFERRED EMBODIMENT

Figure 1:
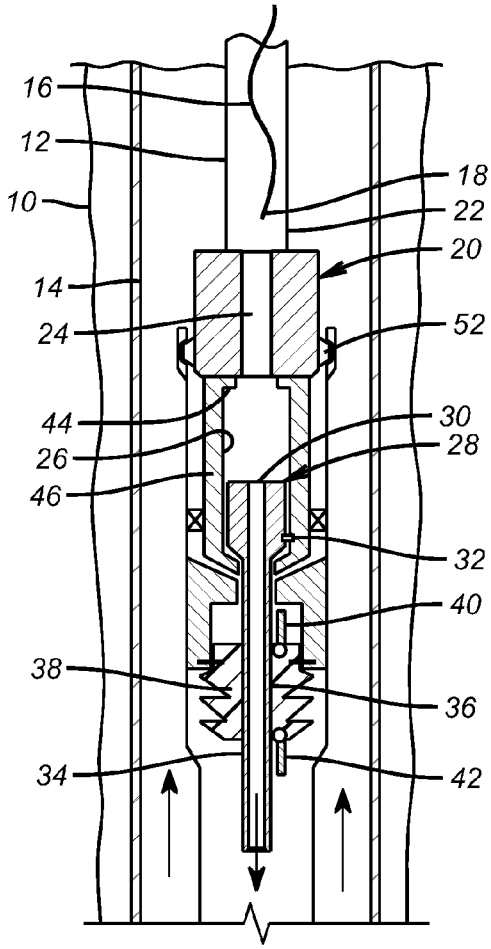
FIG. 1 shows running the liner into the hole.

Referring to FIG. 1 the hole 10 has been drilled with coiled tubing 12 and the bottom hole assembly (BHA, not shown) has been removed in a previous trip. In one example the hole 10 can be a lateral through a window in a main bore with a tubing tail 14 extending into the bore 10. The coiled tubing 12 has electric line 16 still in it with a lower end 18 put at a distance from the running tool 20 by a few larger diameter collars 22. The running tool 20 has a flow passage 24 that has an enlarged portion 26. A stinger 28 has a through passage 30 is initially fixated with a shear pin 32. The stinger 28 has a tail pipe 34 that extends through a passage 36 in wiper plug 38. Flappers 40 and 42 are pivotally mounted to the wiper plug 38 and held open in FIG. 1 by the extension of the tail pipe 34 in passage 36. Shoulder 44 defines an upper travel stop for the stinger 28 in the enlarged portion 26.

Figure 2:
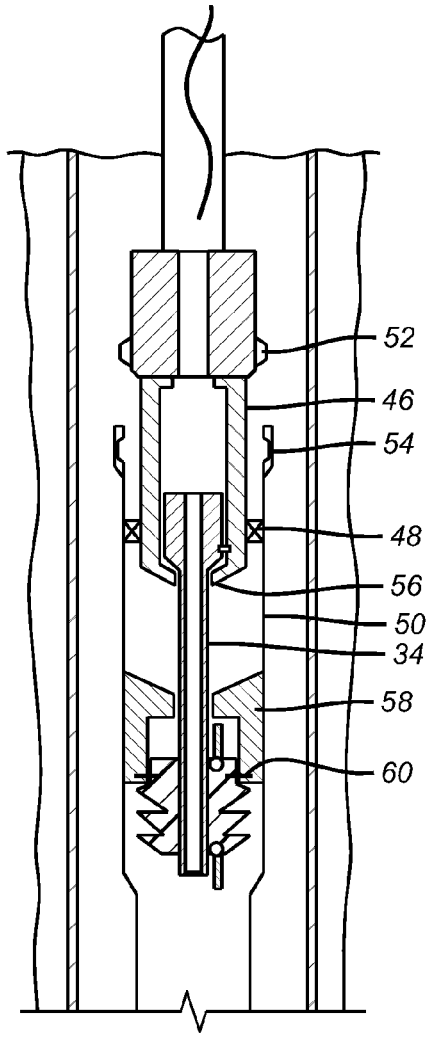
FIG. 2 is the view of FIG. 1 with the running tool released from the liner but still in sealing engagement to the liner.

The running tool 20 has a housing 46 that has external seals 48 to engage the liner 50 as well as a gripping mechanism 52 to engage groove 54 for run in and to selectively release from groove 54, as shown in FIG. 2 with the seals 48 still engaged. Housing 46 has a lower opening 56 through which tail pipe 34 extends for run in. The lower limit of travel for the stinger 28 is shown in FIG. 2 where the lower end of the housing 46 around the opening 56 acts as the lower travel stop. Liner 50 has a deployment sleeve 58 internally secured with wiper plug 38 pinned to it with shear pin 60 housed within an aluminum insert retained at bottom of deployment sleeve 58.

Figure 5:
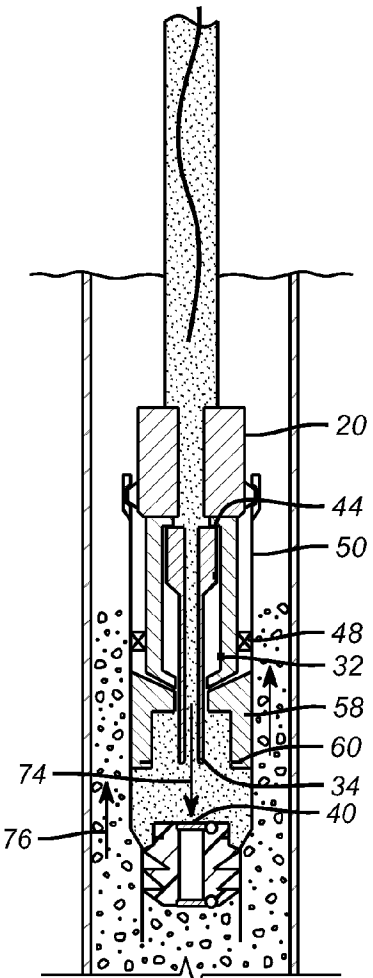
FIG. 5 shows the coiled tubing set back down to seal the running tool to the liner so that the wiper plug can be launched with applied coiled tubing internal pressure.
Figure 4:
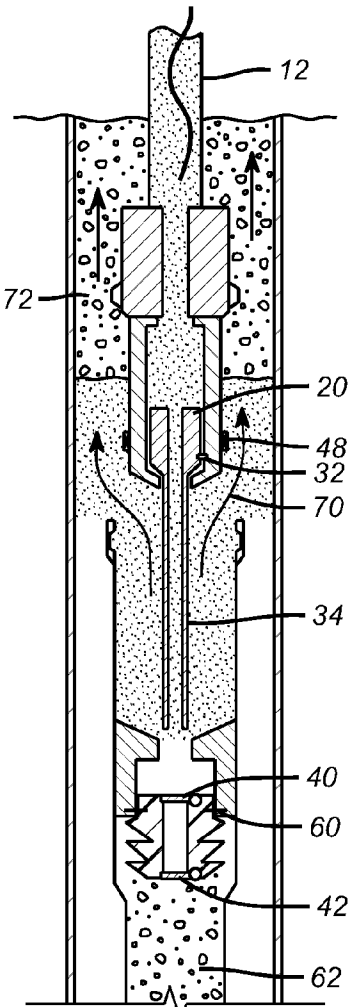
FIG. 4 is the view of FIG. 3 with the running tool picked up and the wiper plug flappers shut to allow circulation out of the excess cement with the liner isolated at the wiper plug.
Figure 3:
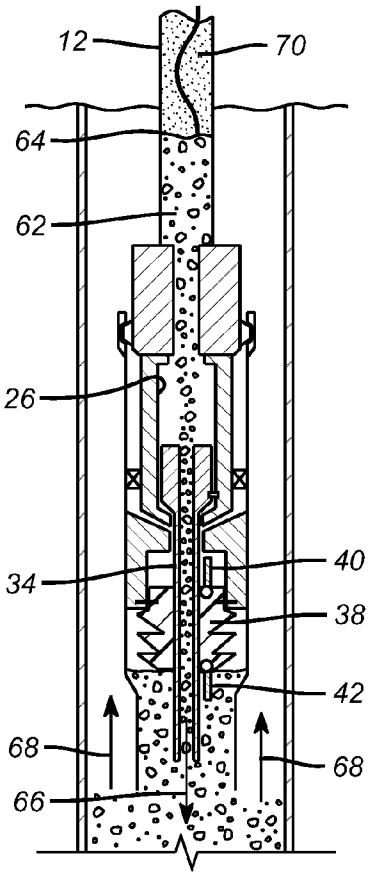
FIG. 3 shows the view of FIG. 2 with cement delivered to a height above the running tool.

The various parts of the apparatus now having been identified, the operation of the tool will be reviewed in greater detail. In FIG. 1 the coiled tubing 10 with the electric line 16 still inside are rigged up to the liner 50 to run it to the hole bottom. Once at hole bottom, the liner 50 is released at 54 from the grip mechanism 52. This is typically done with a ball landed on a seat and pressure buildup, none of which is shown, but is a well known technique for releasing a liner from a running tool. As shown in FIG. 2 the coiled tubing 10 is lifted only enough to determine that running tool 20 has released from liner 50. Note that the seals 48 still engage the interior of the liner 50 and flappers 40 and 42 are still held open by tail pipe 34. Referring now to FIG. 3 cement 62 is delivered down the coiled tubing 10 up to a level 64. The cement fills the enlarged volume 26 and goes into the liner 50 through the tail pipe 34 and past the held open valves 40 and 42 as indicated by arrow 66. Arrows 68 indicate the direction of fluid displaced from the annulus as some of the cement goes out the bottom of the shoe (not shown) at the lower end of the liner 50. The reason extra cement is used up to a level 64 is to insure that the cement that gets beyond the flappers 40 and 42 is not contaminated by fluid 70 delivered behind the cement 62 to spot it into the FIG. 3 position. Now with the assurance that the cement below the wiper plug 38 is not contaminated, the coiled tubing 10 is lifted raising the stinger 28 and with it the tail pipe 34 above both flappers 40 and 42 so that they can be biased along their pivot axis to the closed position shown in FIG. 4. Note that the seals 48 are now out of the liner 50. Circulation through the coiled tubing 10 represented by arrows 70 removes the excess cement 72 without raising the circulation pressure to the point of breaking the shear pin 60 that retains the wiper plug 38 to the deployment sleeve 58. The cement 62 below the wiper plug 38 is isolated from the circulating fluid by the two flappers 40 and 42. Note that pin 32 holding the stinger 28 to the housing 46 has not yet been sheared. With the excess cement circulated out, FIG. 5 shows setting down weight on the coiled tubing 10 so that the running tool 20 bottoms on the deployment sleeve 58. Seals 48 go back inside liner 50 and set down weight of the coiled tubing 10 results in breaking of shear pin 32 as the tail pipe 34 lands on closed valve 40 as the running tool 20 descends moving the tailpipe 34 and stinger 28 up inside the housing 46 to its travel stop at 44. Arrow 74 represents applied pressure that will break the shear pin 60 to launch the wiper plug 38 because valves 40 and 42 are closed. Arrow 76 represents cement coming through the shoe (not shown) at the bottom of the liner 50 and into the surrounding annulus to finish the cementing job. The pressure 74 can also drive the stinger 28 to its travel stop 44. The coiled tubing 10 is now removed and the running tool 20 and the stinger 28 come out with it. The aluminum insert is subsequently milled out to allow passage of future services tools.

Those skilled in the art will appreciate that the coiled tubing with electric line can now do double duty. The wiper plug can have one or more valves of different designs. The excess cement delivery is optional but helps to confirm that the tail end of the cement delivered below the wiper plug is not contaminated by the fluid behind it that delivered it. Alternatively the running tool can have a ported sleeve to allow excess cement to be circulated out. In broad terms the invention allows the reuse of electric line coiled tubing to cement after the same coiled tubing is used to make the hole. This saves the operator significant sums of money by not needing a second coiled tubing reel to be retained on site. Other modes of delivering the sealing material past the plug and then closing off the plug so it can be launched are contemplated. With the electric line in the coiled tubing, delivering a sealing member through the coiled tubing is challenging but is an alternative mode of operation contemplated by the present invention.

The above description is illustrative of the preferred embodiment and various alternatives and is not intended to embody the broadest scope of the invention, which is determined from the claims appended below, and properly given their full scope literally and equivalently.

We claim:

1. A drilling and completion method for subterranean use, comprising:

drilling with a bit supported by coiled tubing having an electric line therein;

running in, after said drilling, a bottom hole assembly comprising a string to be sealed and with the same coiled tubing having said electric line therein;

sealing said string;

pulling out said coiled tubing with the electric line therein.

2. A drilling and completion method for subterranean use, comprising:

drilling with a bit supported by coiled tubing having an electric line therein;

running in, after said drilling, a bottom hole assembly comprising a string to be sealed and with the same coiled tubing having said an electric line therein;

sealing said string;

pulling out said coiled tubing with the electric line therein;

delivering sealing material through said coiled tubing;

sending a plug down said string to displace sealing material into an annular space around said string;

opening a path from said coiled tubing into a surrounding annulus to said coiled tubing located above said string;

removing excess sealing material from the coiled tubing through said opened path.

3. The method of claim 2, comprising:

opening said path by releasing a seal between said coiled tubing and said string.

4. The method of claim 2, comprising:

opening said path by moving said coiled tubing to take a seal out of contact with said string.

5. A drilling and completion method for subterranean use, comprising:

drilling with a bit supported by coiled tubing having an electric line therein;

running in, after said drilling, a bottom hole assembly comprising a string to be sealed and with the same coiled tubing having said an electric line therein;

sealing said string;

pulling out said coiled tubing with the electric line therein;

providing a wiper plug in said bottom hole assembly selectively secured in said string; delivering sealing material through said plug.

6. The method of claim 5, comprising:

providing at least one closure in said plug in an open position for delivering sealing material.

7. The method of claim 6, comprising:

holding said closure in an open position with a stinger through which said sealing material is delivered.

8. The method of claim 7, comprising:

retracting said stinger from said plug to operate said closure to a closed position.

9. The method of claim 8, comprising:

using a flapper as said closure;

providing at least two closures as said at least one closer both of which are flapper valves.

10. The method of claim 8, comprising:

lifting a bottom hole assembly seal out of said string with said retracting said stinger.

11. The method of claim 10, comprising:

pumping fluid through said stinger to exit above said plug with said closure in a closed position to remove excess sealing material from said coiled tubing.

12. The method of claim 11, comprising:

releasing said plug after said removal of excess sealing material.

13. The method of claim 12, comprising:

releasing said plug by landing said stinger on said closure.

14. The method of claim 12, comprising:

releasing said plug by reinserting said bottom hole assembly seal in said string and building pressure in said coiled tubing.

15. The method of claim 12, comprising:

breaking a shear pin to release said plug.

16. The method of claim 15, comprising:

using a flapper as said closure;

providing at least two closures as said at least one closer both of which are flapper valves.

17. The method of claim 12, comprising:

selectively securing said stinger to a housing;

releasing said stinger to move relatively to said housing when releasing said plug.

18. The method of claim 12, comprising:

driving said plug with pressure after said release to displace sealing material from said string with said closure in said plug in a closed position.

19. The method of claim 18, comprising:

supporting said plug with a sleeve made of a soft material;

removing said bottom hole assembly after driving said plug;

milling out said supporting sleeve for said plug.

* * * * *

UNITED STATES PATENT AND TRADEMARK OFFICE

CERTIFICATE OF CORRECTION

PATENT NO. : 8,220,544 B2
APPLICATION NO. : 12/637105
DATED : July 17, 2012
INVENTOR(S) : Robert Harris and Mark Johnson It is certified that error appears in the above-identified patent and that said Letters Patent is hereby corrected as shown below:

On the Title Page at (73) Assignee: Baker Hughes Incorporated, Houston, TX (US)
please insert: -- BP Corporation North America Inc., Warrenville, IL (US) --.

Signed and Sealed this
Fifth Day of November, 2013

Teresa Stanek Rea

Teresa Stanek Rea
*Deputy Director of the United States Patent and Trademark Office*